United States Patent [19]

Mignano

[11] 4,032,132

[45] June 28, 1977

[54] COLLATOR ARM FEED HEAD

[76] Inventor: Frank J. Mignano, 293 8th St., Brooklyn, N.Y. 11215

[22] Filed: July 28, 1976

[21] Appl. No.: 709,549

Related U.S. Application Data

[63] Continuation-in-part of Ser. No. 632,511, Nov. 17, 1975, abandoned.

[52] U.S. Cl. ..... 270/58; 271/9; 271/42; 271/258

[51] Int. Cl.² ..... B65H 39/05

[58] Field of Search ..... 270/56–59; 271/9, 42, 258, 259, 265; 221/259

[56] References Cited

UNITED STATES PATENTS

| | | | |
|---|---|---|---|
| 2,844,370 | 7/1958 | Thomas | 271/42 |
| 3,208,745 | 9/1965 | March | 270/58 |
| 3,664,656 | 5/1972 | Ryland | 270/58 |

FOREIGN PATENTS OR APPLICATIONS

| | | | |
|---|---|---|---|
| 560,694 | 9/1932 | Germany | 271/42 |

*Primary Examiner*—Edgar S. Burr
*Assistant Examiner*—A. Heinz
*Attorney, Agent, or Firm*—Peter L. Tailer

[57] ABSTRACT

In a collating machine having paper bins with papers therein to be collated, paper ejection arms simultaneously moving the uppermost sheet in each bin with an ejection stroke, and a system collecting the uppermost moved sheets; a feed head on each ejection arm having a mounting bracket, rollers mounted on a shaft journalled in the bracket to roll on papers in a bin, and rachet means preventing rotation of the rollers during the ejection stroke of each arm. The shaft of each feed head is journalled in elongated slots so that withdrawal of an uppermost sheet moves the shaft in the slots to cause electrical contacts to indicate a sheet from each bin has been collated. The rachet means may be a rachet wheel mounted on each shaft and a pawl mounted on each bracket and the electrical contacts may be the rachet wheel and pawl which break contact as each uppermost sheet of a bin is withdrawn by the collection system.

10 Claims, 11 Drawing Figures

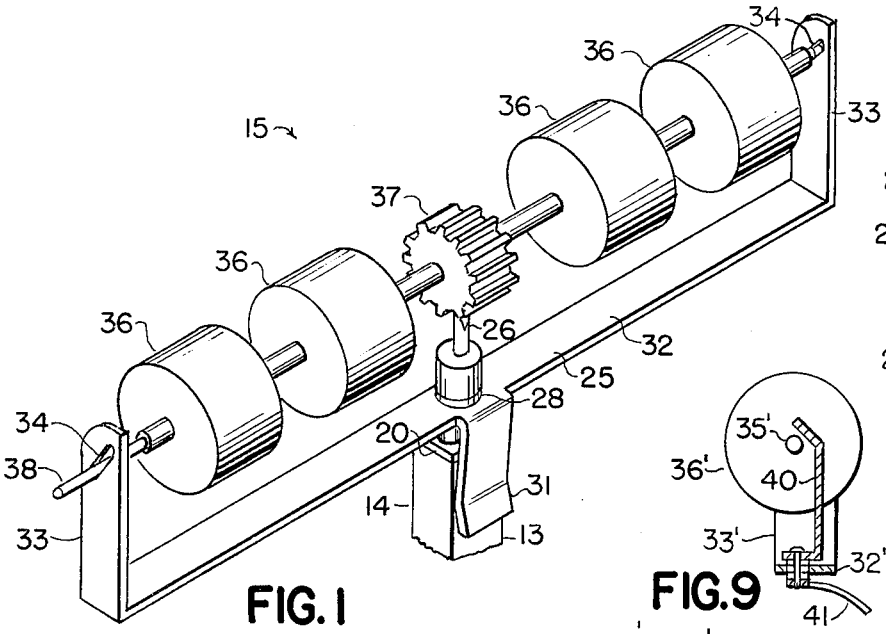
FIG. 1
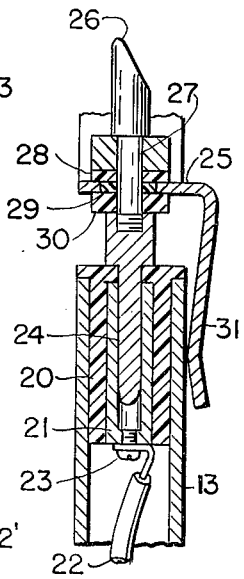
FIG. 8
FIG. 9
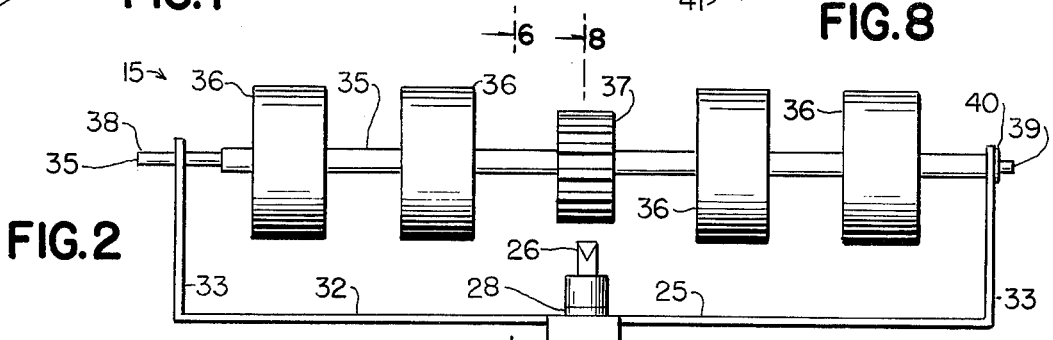
FIG. 2
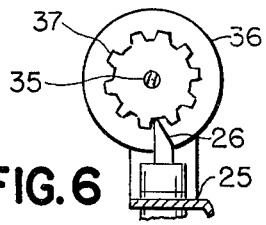
FIG. 6
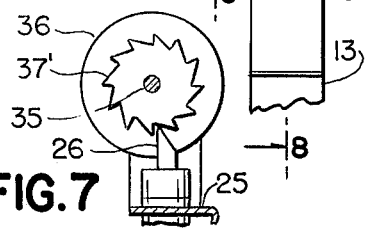
FIG. 7
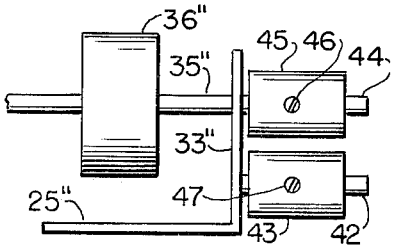
FIG. 10
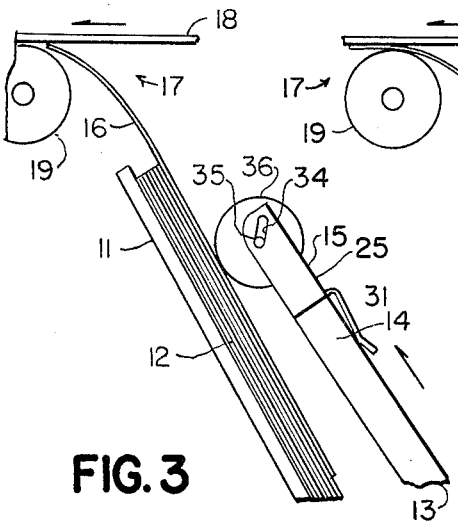
FIG. 3
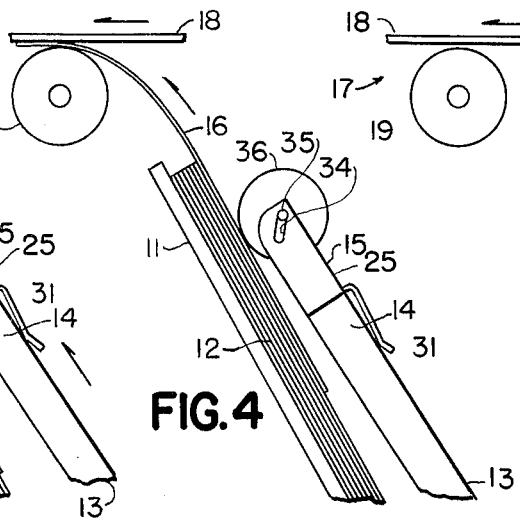
FIG. 4
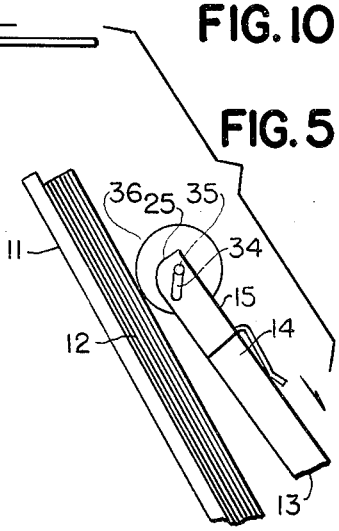
FIG. 5

COLLATOR ARM FEED HEAD

CROSS-REFERENCES TO RELATED APPLICATIONS

This application is a continuation-in-part of my patent application Ser. No. 632,511 filed 11-17-75 and now abandoned.

BACKGROUND OF THE INVENTION

1. Field of the Invention

This invention relates to collating machines and other paper handling devices in which a plurality of bins each contain a stack of papers. Ejection arms with feed heads thereon reciprocate over the bins so that the feed heads move the uppermost sheet in each bin during an ejection stroke, the moved sheets being collected and collated or otherwise processed by other machine elements.

2. Description of the Prior Art

A conventional collator arm feed head has an articulated rubber coated foot with means fixing it at one end of each arm. The arms simultaneously reciprocate through an ejection stroke and a return stroke and the feet are articulated to push uppermost sheets of paper from bins below the arms on the ejection strokes. As a collecting system withdraws uppermost pushed sheets and as arms make return strokes, the relative movement of paper under a foot causes it to pivot. This pivoting causes electrical contacts to indicate that the uppermost sheets of each bin have been collated. As will be described, the conventional feed head is not completely satisfactory.

SUMMARY OF THE INVENTION

Collating machines have paper bins with papers therein to be collated, ejection arms which are reciprocated over the bins to move the uppermost sheet of each bin upward, and a collection system to gather the uppermost moved sheets from all the bins. This invention provides superior ejection arm feed heads, each of which has a bracket mounted on an ejection arm, the bracket containing elongated slots in parallel projections. The slots extend to some extent in the direction of motion of the arms over the paper. An axle is journalled in the slots of each bracket and rollers are mounted on each axle. A rachet wheel is fixed on each axle and a pawl is fixed to each bracket to engage the corresponding rachet wheel when its axle is at the ends of the elongated slots remote from the end of the ejection stroke of each arm.

As the ejection stroke starts, the rollers urge their axles toward the pawls to engage the rachet wheels and lock the rollers to push uppermost sheets from the bins. When the partially ejected sheets are pulled by the collecting system, the rollers roll on the pulled sheets and the axles move to the ends of the slots disposed toward the end of the ejection strokes of the arms. This disengages the rachet wheels from the pawls and allows the rollers to roll freely as paper is withdrawn and as the return stroke is completed.

In a preferred embodiment of this invention, each pawl and rachet wheel are a pair of electrical contacts that, moving apart and breaking contact as an uppermost sheet is withdrawn, indicate that a sheet is engaged by the collection system. If the contacts are connected in parallel as in conventional collating machines, the collator feed heads will indicate whether sheets from each bin are collated each cycle.

The conventional collator arm feed head has an articulated rubber coated foot that pivots on withdrawal of a sheet to break an electrical contact and indicate collation of all sheets. The conventional foot has an uppermost sheet dragged from beneath it and it is then dragged over the next sheet on the return stroke of its arm. This wears the rubber coating on the edge of the foot so that a costly replacement is eventually required. In contrast, the rubber rollers of the instant invention wear evenly over their entire circumference, they roll and are not dragged over paper, and they thus have an almost indefinite service life.

A further feature of the instant invention provides for the sloping of the elongated slots away from the paper in the direction of the end of the ejection strokes of the arms. When a sheet of paper is then withdrawn below a set of rollers, their axle will be more strongly urged to move in the direction of the withdrawing sheet to disengage its rachet wheel from its pawl.

As well as providing a much longer service life in a simpler, less costly, and more efficient feed head, this invention provides for weights to be added to the axles or ejection arms to collate heavier grades or weights of papers. In conventional collating machines having feed heads with articulated feet, the entire feed head has to be changed to accommodate different weights of paper. Further, the feed heads of this invention may be used with lighter, thinner papers as the rolling of the rollers on return strokes will not crumple uppermost sheets as will the dragging of a conventional articulated foot.

BRIEF DESCRIPTION OF THE DRAWING

FIG. 1 is a perspective view of a broken away end of a collating machine ejection arm with a feed head of this invention mounted on it;

FIG. 2 is a front view of the feed head of FIG. 1;

FIGS. 3–5 are each a side view of a fragment of a bin having a broken away end of an ejection arm and an attached feed head reciprocating thereover and having a broken away fragment of a collection system above the bin, FIGS. 3–5 showing stages in the ejection and return strokes of the arm;

FIG. 6 is a section taken on line 6–6 of FIG. 2 showing a rachet wheel moved into engagement with a pawl;

FIG. 7 is a view similar to that of FIG. 6 showing a modified rachet wheel;

FIG. 8 is a section taken on line 8—8 of FIG. 2 showing the broken away end of an ejection arm and the attachment of a fragment of a bracket of a feed head to it;

FIG. 9 is a transverse section through a bracket having a separate electrical contact fixed to it;

FIG. 10 is a front view of a fragment of a feed head having attached weights.

Figure 11:
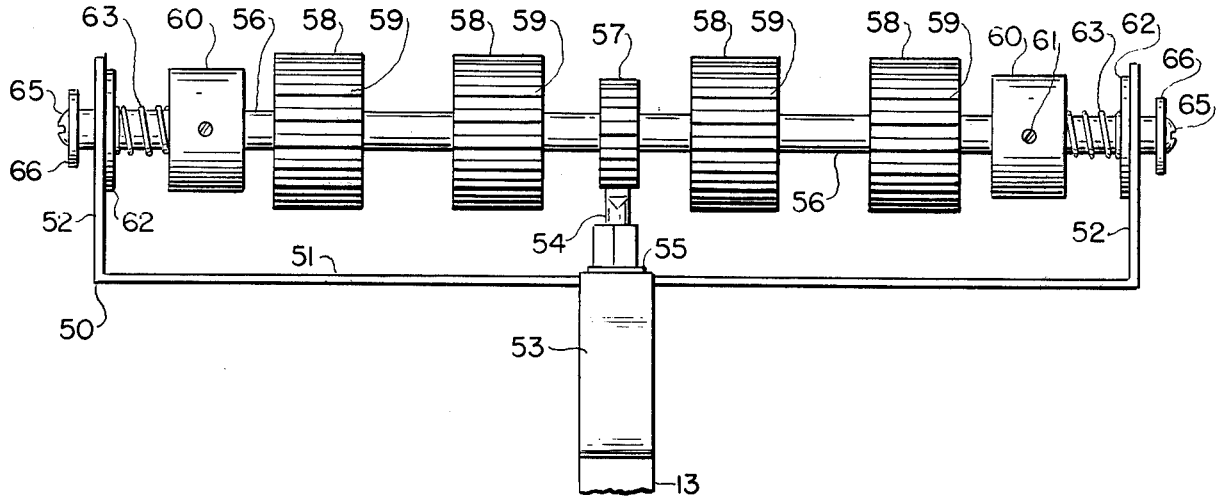
FIG. 11 is a front view of a modified feed head.

DESCRIPTION OF THE PREFERRED EMBODIMENTS:

As shown in FIGS. 3–5, a conventional collating machine has a number of adjacent inclined bins 11 in which stacks of papers 12 are placed to be collated, one paper 12 from each bin 11. Arms 13 simultaneously move up and down over the bins 11 in ejection and return strokes and have free upper ends 14 with heads 15 attached to them to engage the uppermost sheet 16 of each stack of papers 12. On the upward moving ejection stroke, each head 15 pushes the uppermost sheet 16 into the collecting system 17 shown as a moving belt 18 and co-acting rollers 19.

As may be seen in FIGS. 3, during the ejection stroke of an arm 13, an uppermost sheet 16 is pushed by head 15 against moving belt 18. As shown in FIG. 4, at about the top of an ejection stroke of an arm 13, the uppermost sheet 16 of each bin 11 is drawn between belt 18 and a roller 19 to be pulled from bin 11 from under head 15 by the collating system 17. All the uppermost sheets 16 are then passed in an overlapped relationship by system 17 to form collated bundles (not shown). As shown in FIG. 5, the return stroke of each arm 13 draws its attached head 15 downward over a stack of papers 12.

A feed head 15 according to this invention is shown in FIGS. 1, 2, 6, and 8 attached to an arm 13. The upper end of each square tubular arm 13, as may be seen in FIG. 8, contains an insulating plug 20 containing a tubular insert 21 to which a wire 22 is attached by a screw 23 or the like. Feed head 15 has a conducting plug 24 which is pushed into tubular insert 21. Plug 24 has bracket 25 fixed to it by means of a pawl 26 and its shank 27 which is turned into or otherwise fixed to the upper end of plug 24. Insulating elements 28–30 electrically isolate pawl 26 from bracket 25. Bracket 25 has a clip 31 which may be integrally formed with it to make an electrical contact between bracket 25 and arm 13 and also to rotatably orient bracket 25 on arm 13.

Each bracket 25 has a base 32 from which parallel projections 33 are bent. Projections 33 contain elongated apertures or slots 34 which preferably slope away from the stacks of paper 12 in the direction of the ejection strokes of the arms 13. An axle 35 rests in each pair of slots 34 and has rollers 36 of rubber of like high friction material mounted on it. A rachet wheel 37 is also mounted on axle 35 adjacent to pawl 26.

As may be seen in FIGS. 6 and 7, rachet wheel 37 may be a conventional spur gear or it may be a conventional rachet wheel 37'. As shown in FIGS. 1 and 2, axle 35 may have smaller diameter ends 38 and 39 and mount a retaining clip 40 to removably mount it in slots 34. Any other conventional means may be used to secure axle 35 in slots 34.

Referring to FIGS. 1–5, a feed head 15 of this invention functions in the following manner. On the start of an up or ejection stroke of arms 13, each axle 35 moves to the ends of slots 34 closest to pawl 26. This movement is caused by resistance of the rollers 36 moving over papers 12, by weight of the rollers 36 and the axles on which they are mounted, and by the rotation of shafts 35 within slots 34 while the shafts 35 are pressed against the edges of slots 35 remote from the papers 12. This movement of each axle 35 engages a corresponding pawl 26 and a rachet wheel 37 or 37' to lock and prevent rotation of rollers 36 and and push up an uppermost sheet 16 as shown in FIG. 3.

As shown in FIG. 4, when uppermost sheet 16 is engaged by the collection system 17, it is pulled from bin 11 and from under the rollers 36 resting on it. This pulling causes axle 35 to move in the direction of the ejection stroke in slots 34, the movement being caused by friction of the rollers 36, the weight or spring biasing of each arm 13 in the direction of a sheet 16, and rotation a axle 35 in slots 34 while being pressed against the edges of slots 34 remote from a sheet 16. This movement disengages each pawl 26 from its rachet wheel 37 or 37' to allow the rollers 36 to roll freely over papers 12 with almost no wear. The disengagement of pawl 26 with rachet wheel 37 also breaks an electrical contact between each wire 22 and its arm 13, the contact being through pawl 26, rachet 37 or 37', axle 35, frame 25, and clip 31. This breaking of contact at each bin 11 indicates to the collator through old and well known circuitry that a sheet 12 has been collated from each bin during each reciprocation of the arms 13. If a sheet is not collated from a bin 11, the circuitry stops the collator or rejects the collated bundle of papers 12. In conventional collator feed heads, the breaking of contact is caused by the articulation of a rubber coated foot that drags on each uppermost sheet 16. This wears the rubber coating and requires its costly replacement.

As shown in FIG. 5, on the return stroke of each arm 13, the rollers 36 turn freely as the axle 35 remains at the ends of slots 34 remove from pawl 26. Since there is no dragging of rollers 36 over papers 12 and the entire circumferential surfaces of the rollers 36 are used to contact the papers 12, the feed head 15 of this invention has an indefinite service life.

As shown in FIG. 9, a non-conducting pawl or rachet wheel (not shown) may be used if a contact strip 40 is mounted on base 32' to indicate movement of axle 35' which contacts it to make or break an electrical connection. Contact strip 40 is insulated from base 32' and has a wire 41 connected to it.

FIG. 10 shows a bracket 25'' with a rod 42 welded to each projection 33''. A weight 43 is fixed to each rod 42 by means of a set screw 47 or the like if greater pressure is required to feed heavy papers 12. Axle 35'' has smaller diameter ends 44 to which weights 45 are fixed by means of set screws 46 if it is required to weight axle 35'' for heavier papers 12.

The angle the elongated apertures or slots 34 make with the axis of each arm 13 vary from being parallel to the axes of the arms 13 to an angle in excess of 45° away from papers 12 in the direction of ejection strokes. The best angle for the slots 34 depends on the relative weights and inclination of arms 13 and brackets 25 and the weights of the axles 35 and the elements mounted thereon. The greater the angle of the slots 34 with the axes of the arms 13, the more readily will an axle 35 move in its slots 34 to disengage its rachet wheel from its pawl 26.

As shown in FIG. 11, a bracket 50 has a base 51 from which parallel projections 52 are bent containing elongated slots as has been described. A clip 53 is fixed to base 51 by pawl 54 which is mounted on an insulating grommet 55. A shaft 56 is journalled in the projections 52 and has rachet wheel 57 fixed on it. Rubber rollers 58 with longitudinal ribs 59 are press fit on shaft 56.

Cylindrical weights 60 are fixed to shaft 56 a spaced distance away from the projections 52 by means of set screws 61. Nylon brake disks 62 are disposed on shaft 56 adjacent to the projections 52. Compression springs between the weights 60 and the brake disks 62 are designated by the reference numeral 63 and urge the disks 62 against the projections 52. Cap screws 65 and washers 66 may be used to complete the assembly.

In high speed collating machines the uppermost sheet 16 of each bin is withdrawn with such speed by the belt 18 and rollers 19 that each shaft 56 and attached elements may be given a great enough spin to kick up the sheet below after a top sheet is removed. The slight brake action of the disks 62 prevents this. The brake action can be regulated by moving the weights 60 inward or outward. A further advantage results in that a slight brake action on rollers 58 will pull back downward any second sheet that sticks to a first sheet and remains in a slightly extended position. While weights 60 are shown as elements to provide the adjustable brake action, any stop could be used that could be mounted on shaft 56. For heavier papers, weights 60 are more effective on the shafts 56 or 35 than on the brackets 50 or 25 or the arms 13.

Bracket 25 could be molded of plastic which would be non-conductive. Two contacts 40, as shown in FIG. 9, would then be provided to indicate movement of shaft 35' when it contacted them to send a current therethrough or broke the contact. If a plastic bracket 25 is used, a contact 40 may be provided which extends between shaft 35' and base 32'. Another contact would be made between a conducting rachet wheel 37 and its pawl 26 so that interruption of current flowing from pawl 26 to contact 40 would indicate movement of shaft 35'. While pawl 26 has been shown in the center of bracket 25, it could be offset from the center along with its rachet wheel 37.

While this invention has been shown and described in the best forms known, it will nevertheless be understood that these are purely exemplary and that modifications may be made without departing from the spirit of the invention.

What is claimed is:

1. In a collating machine having paper bins with papers therein to be collated, paper ejection arms reciprocating with ejection and return strokes over said bins, feed heads on said arms moving the uppermost sheet in each bin on ejection strokes of said arms, and a system collecting uppermost moved sheets from said bins, the improvement comprising, in combination, a collator feed head on each of said arms, each of said feed heads having a bracket attached to one of said arms, projections of said bracket containing slots extending generally in the direction of the ejection strokes of said arms, a shaft journalled in said slots, rollers mounted on said shaft, a rachet wheel mounted on said shaft, a pawl fixed to said bracket adjacent to said rachet wheel, said pawl being disposed in the direction of return strokes of said arms, said rollers contacting the uppermost sheet of papers in said bin therebelow so that, on ejection strokes of said arms, said shaft moves in said slots engaging said rachet wheel with said pawl locking said rollers to move an uppermost sheet and, on collection of uppermost sheets and on return strokes of said arms, said shaft moves in said slots disengaging said rachet wheel from said pawl enabling said rollers to freely roll on papers thereunder, and electrical contact means associated with said shaft indicating movement of said shaft in said slots and thereby the collection of an uppermost moved sheet of paper from each of said bins.

2. The combination according to claim 1 wherein said electrical contact means is said pawl and said rachet wheel, said pawl being electrically insulated from said bracket, said shaft and said bracket being conductive.

3. The combination according to claim 2 wherein said slots extend at an angle away from papers in said bin therebelow in the direction of the ejection strokes of said arms.

4. The combination according to claim 1 wherein said slots extend at an angle away from papers in said bin therebelow in the direction of the ejection strokes of said arms.

5. The combination according to claim 1 wherein said rachet wheel is a spur gear.

6. The combination according to claim 1 wherein said rachet wheel is a conventional rachet wheel.

7. The combination according to claim 1 wherein said electrical contact means includes at least one contact mounted on said bracket to be contacted by said shaft on movement of said shaft in said slots.

8. The combination according to claim 1 with the addition of brake means on said shaft.

9. The combination according to claim 8 wherein said brake means comprise disks on said shaft adjacent to said projections, and compression springs on said shaft urging said disks against said projections.

10. The combination according to claim 1 with the addition of weights fixed to said shaft increasing pressure of said rollers on the uppermost sheet of papers in said bin therebelow.

* * * * *